United States Patent [19]

Hayden et al.

[11] Patent Number: 4,934,687

[45] Date of Patent: Jun. 19, 1990

[54] HIGH SPEED STREAM FED STACKER METHOD AND SYSTEM FOR PRINTED PRODUCTS

[75] Inventors: William Hayden, Easton; Mark W. Hayden, Monroe; Richard S. White, Old Saybrook, all of Conn.

[73] Assignee: Galpin Research, Limited Partnership, Stratford, Conn.

[21] Appl. No.: 142,736

[22] Filed: Jan. 11, 1988

[51] Int. Cl.[5] ..... B65D 29/66; B65D 31/00

[52] U.S. Cl. ..... 271/202; 271/69; 271/209; 271/217; 198/461; 414/789.9; 414/794.4

[58] Field of Search ..... 271/218, 215, 217, 188, 271/210, 250, 202, 270, 258, 259, 265, 209, 69, 189, 182, 188; 414/45, 46, 50, 788.1, 789.9, 794.4; 198/425, 422, 461

[56] References Cited

U.S. PATENT DOCUMENTS

| | | | |
|---|---|---|---|
| 3,044,767 | 7/1962 | Winkler et al. | 271/69 |
| 3,160,413 | 12/1964 | Faeber | 271/209 |
| 3,255,895 | 6/1966 | Klinger | 414/50 |
| 3,595,568 | 7/1971 | Roskam | 271/203 X |
| 4,019,640 | 4/1977 | Marin et al. | 271/209 X |
| 4,183,518 | 1/1980 | Brockmüller | 271/182 |
| 4,313,669 | 2/1982 | Larson et al. | 271/209 X |
| 4,345,754 | 8/1982 | Willenbring | 271/209 |
| 4,466,607 | 8/1984 | Clark et al. | 271/209 X |
| 4,502,678 | 3/1985 | Marass . | |
| 4,534,550 | 8/1985 | Reist | 271/270 X |
| 4,652,197 | 5/1987 | Littleton | 271/218 |
| 4,667,949 | 5/1987 | Goodwin et al. | 271/209 X |
| 4,783,065 | 11/1988 | Graves, Sr. | 271/209 X |

*Primary Examiner*—Joseph J. Rolla
*Assistant Examiner*—Steven Reiss
*Attorney, Agent, or Firm*—Parmelee, Bollinger & Bramblett

[57] ABSTRACT

There are disclosed method and apparatus for stacking the output ("documents" or "printed products") of a high speed printing press or bindery line. The documents are shingled on a linear infeed conveyor where they are also aligned, positioned, and counted, all at high speed. When the amount of documents desired for a stack have been counted or weighed or determined by stack size or height, further document flow is temporarily interrupted. The documents are speeded up in an accelerator to reduce the amount of shingling. They are ejected from the accelerator to glide through the air onto a stack starter surface which slowly descends as the stack is formed. The partially completed stack is transferred to a de-elevator and the stack starter returns to begin building a new stack. The de-elevator lowers the completed stack onto a receiving surface and rises to receive the next partially completed stack from the stack starter surface. A pusher then removes the stack from the receiving surface.

25 Claims, 12 Drawing Sheets

100
102
104
106
108
110
112
114
116
118
119
120
122
123
124
126
128
129
130
132
134
136
138
140
142
144
146
148
150
152
154
156
158
115
200
202
204
218
220

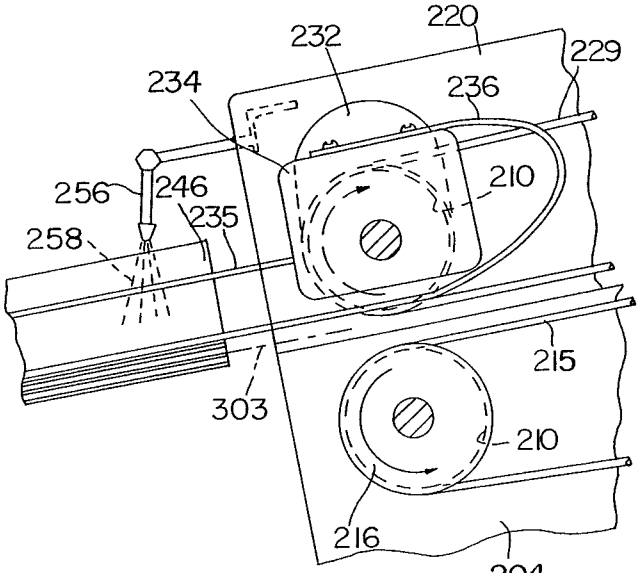
FIG.5
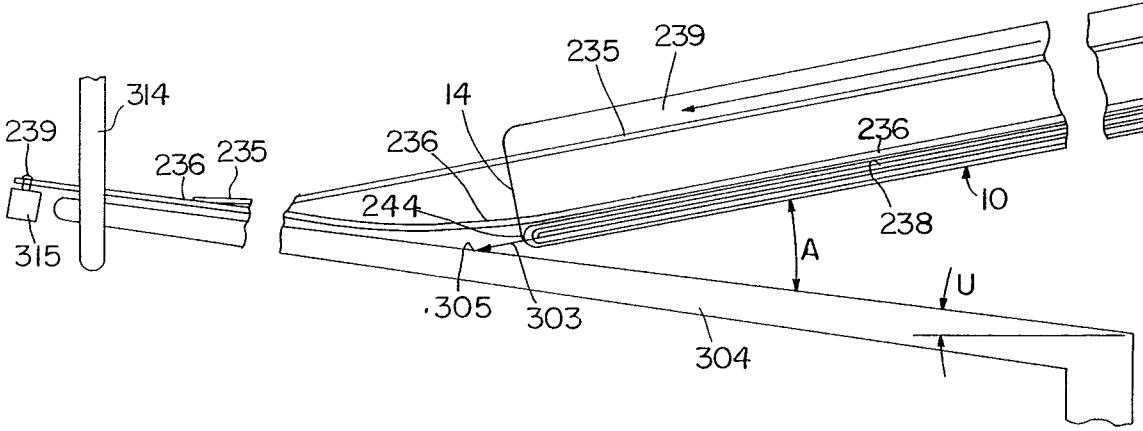
FIG.5A
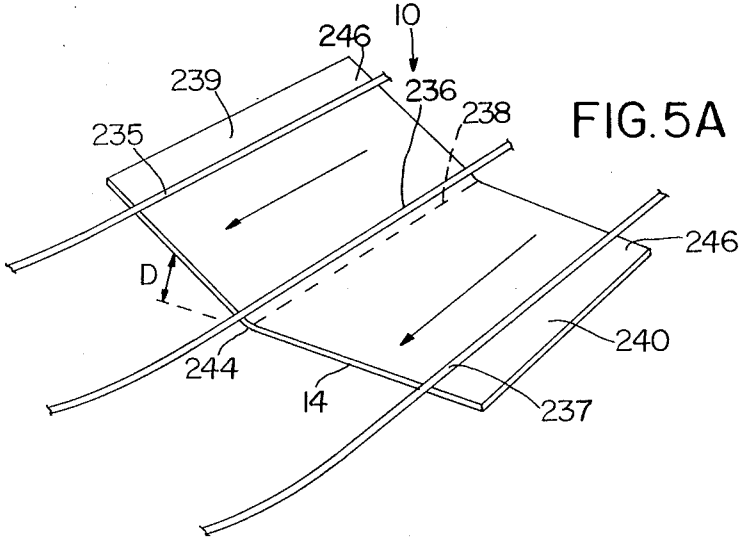

HIGH SPEED STREAM FED STACKER METHOD AND SYSTEM FOR PRINTED PRODUCTS

TECHNICAL FIELD

The field of this invention is the automated handling of printed products from a high speed press or bindery line for forming a neat, stable, precisely aligned stack of these printed products. The products, which may comprise items such as printed book sections or signatures, magazines, newspaper sections, magazine sections or signatures, inserts, brochures, etc. are automatically gathered into groups of pre-selected numbers, the printed products or documents in each group are carefully aligned with one another and positioned in a vertical stack. The precisely aligned stack is then removed for further processing.

DISCLOSURE OF INVENTION

The high speed stacker and system embodying this invention and performing the method of this invention include a constant speed "infeed conveyor" section which receives the product output from a high speed press or bindery line. This product output may be in the form of printed signatures for books or magazines, pamphlets, newspaper sections, magazine sections, inserts, brochures, and the like. Typically, there might be a press output of up to 80,0000 such items per hour streaming rapidly out from a modern high speed printing press. Conventionally, these fast-moving items are "shingled" i.e., partially overlapping, as they travel out from the press on the surface of a generally horizontal conveyor.

Advantageously, the present high speed stream fed stacker method and system of the present invention will run at a rate of zero up to 80,000 book sections or signatures, magazine sections or signatures, magazines, newspaper sections, inserts, etc. per hour and will handle such printed products at this rate even if each printed product has only four pages or if each has as many as thirty-two pages, and will handle printed products with any number of pages between 4 and 32 pages. It is difficult to handle printed products having so few as four pages, because such items are thin and limp and thus difficult to control. Moreover, this stacker method and system will handle up to 80,000 newspapers per hour with each newspaper having up to 64 pages. The neat, aligned, stable stack of printed products is not "dropped". It is kept under control as it is being formed and then is carefully pushed onto a take-away conveyor.

This stacker will handle up to 18,000 completed printed products such as magazines coming from a bindery line.

The infeed conveyor section discussed above performs several functions. It aligns and positions the shingled items relative to one another. It includes means for counting the number of shingled items and temporarily interrupting the flow of printed products when the desired number have been allowed to travel past the site of this temporary interruption. The downstream end of this infeed conveyor section conveys the accumulated number of items to the second section of the stacker, which will now be described.

The second section of the stacker of this invention is an "accelerator", which may be considered to serve as a "singulator". This accelerator (singulator) is also a conveyor section but moves at a higher rate of conveyance speed than the infeed conveyor. It is designed to physically grasp and accelerate each shingled item. As a result of this acceleration, the shingled relationship, i.e. the overlap, between the items is substantially reduced or eliminated. Running at a rate of up to about 40,000 printed products per hour, the overlap of the printed products usually is eliminated, i.e. the printed items are said to have become "singulate", but not above that rate.

A second function of the accelerator (singulator) is to impart to each of the printed items a slight central fold extending in the downstream-to-upstream direction of travel, i.e. to impart a "dihedral", and then to eject them to fly onto the top of a stack being formed to come to rest against a stop fence whereby each printed item in succession is added to the top of the vertical stack being formed. The slight dihedral gives the printed items sufficient rigidity that they will fly at high speed through the air with directional stability and do not crumple when they initially make high speed contact with the central region of the top of the stack.

A third function of the accelerator (singulator) section is to firmly squeeze and crush the folded edge (the "spine") of each printed product so as (i) to create a sharper fold ; and (ii) to squeeze air out from between the sheets of the printed product in the region near its spine. As the printed products are coming out from a modern high speed printing press, their folded spine edges tend to have a rounded configuration rather than a sharp fold. Thus, there is considerable amounts of air trapped between the folded sheets near the spine. If the printed products are stacked up without removing this trapped air, the resultant stack may be unstable.

The stacking section includes a "stacking head" which carries the stop fence and also edge guides. Slight vibration is imparted to the stop fence and/or to the edge guides for agitating the printed items for ensuring that the stack is formed evenly and accurately. Another element of the stacking section is a tined "stack starter" which receives the initial items forming each stack. The stack starter descends as the stack forms. As the stack starter descends, a tined "de-elevator" rises into a position for receiving the partially completed stack which is being formed on the stack starter. The tines of this de-elevator become interjacent with those of the stack starter so that the partially completed stack becomes deposited on the de-elevator. The stack starter is then withdrawn, and the de-elevator descends with the growing stack and deposits it on a "receiving deck". The final element of the stacker section is a "pusher" which transfers the completed stack from this receiving deck onto a take-away conveyor or other removal apparatus.

Returning to a consideration of the stack starter, it is sloped upwardly slightly in a direction away from the accelerator section. The printed products which are ejected from the accelerator at relatively high speed (each having a dihedral configuration) are aimed downwardly and are guided downwardly along a glide path with a target region about half-way out along the upwardly sloping tines of the stack starter. The tail end of the flying printed product drops down onto the stack starter aided by a downward air blast on the trailing portion.

BRIEF DESCRIPTION OF DRAWINGS

FIG. 5 is an enlarged elevational sectional detail view of the downstream end of the accelerator section, and of the stacker section showing the guided glide path of the printed products ejected from the accelerator section into the stacker section.

FIG. 5A is a perspective view of a printed product having the dihedral angle created by the canted ejection rolls at the downstream end of the accelerator section. The printed product is flying rapidly through the air in this configuration.

FIG. 5B illustrates generally the dynamic aspects of the movement of the fast-travelling printed product and shows the action of position sensors for sensing when the products are too high or too low relative to the stack being formed.

BEST MODE FOR CARRYING OUT THE INVENTION

Figures 1A, 1B, 1C, 1D:
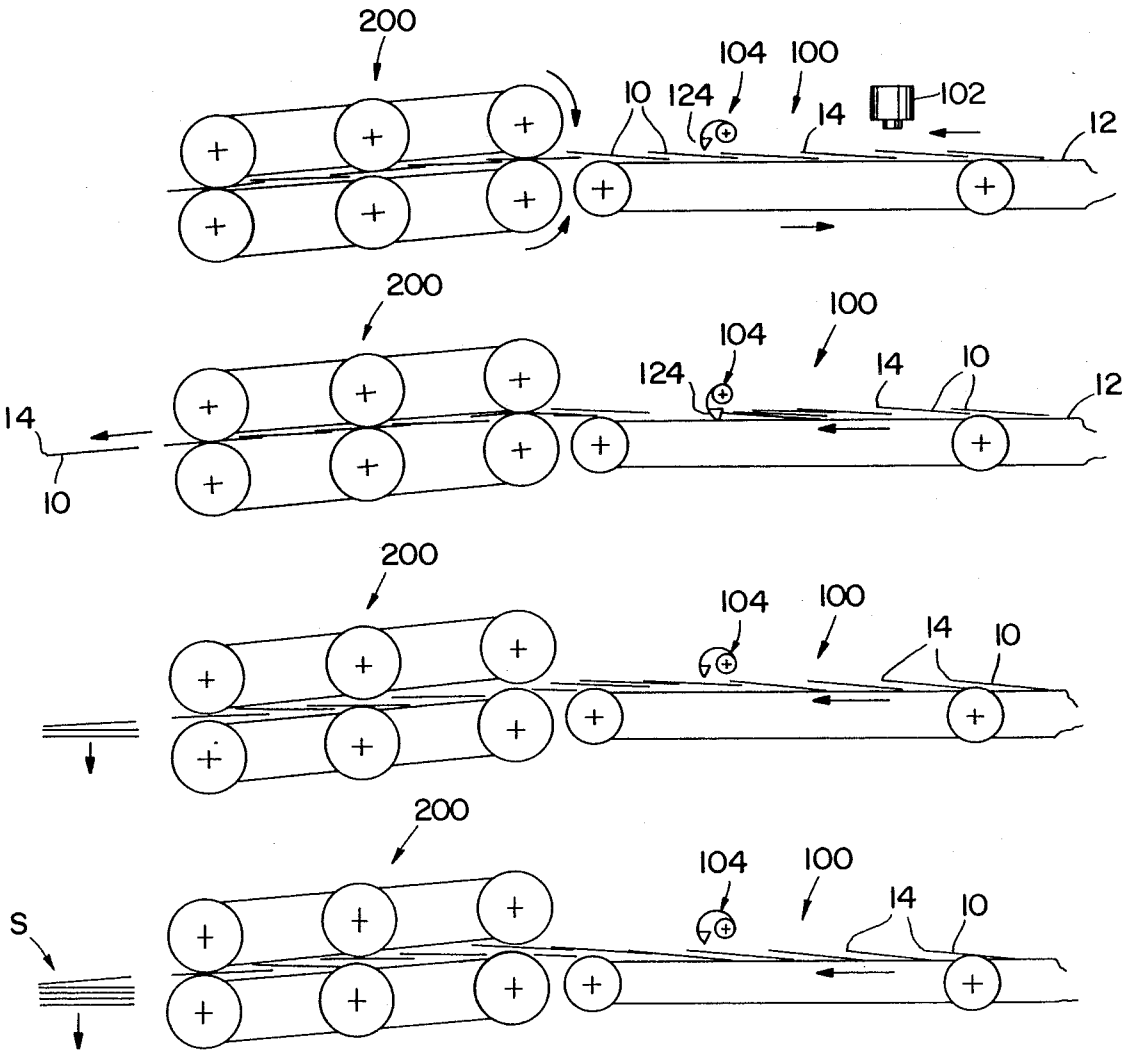
FIGS. 1 (*a*)-(*d*) are a schematic illustrations of four stages in the operation of the infeed conveyor section and accelerator (singulator) section.

In the following description the formation of stacks from printed products or documents, for example such as, signatures streaming rapidly out from a modern high-speed printing press will be described. However, it will be understood that the stacker of this invention may be used in conjunction with many types of printed materials or printed products as set forth in the introduction. Referring first to FIGS. 1*a*, 1*b*, 1*c* and 1*d* there is illustrated the cooperation of the infeed conveyor section 100 and the accelerator (singulator) section 200. As will be seen in FIG. 1*a* printed products 10 are received in shingled, or overlapping, arrangement by the infeed conveyor section 100 from a press output conveyor 12. These signature are all traveling rapidly with their folded edges 14, called the "spine", facing forward, or the spines 14 may all face to one side or the other. Infeed conveyor section 100 includes a counter, such as infrared counter 102, which senses the leading edges of the printed products and counts them as they pass beneath it. Upon reaching a predetermined count, a flow interrupter 104 has its presser foot 124 (Please see also FIG. 2A) activated downwardly into a clamping position, such as shown in FIG. 1*b*, temporarily interrupting the flow of signatures along the infeed conveyor section 100.

The accelerator section 200 runs at a substantially greater speed than does the infeed conveyor section 100. For example, the linear feed rate of the accelerator section 200 is in the range from 1.5 to 3.5 times the linear feed rate of the infeed conveyor section 100. Furthermore, this accelerator section physically grasps each signature 10, sharpening the spine fold 14 and squeezing out air. In accelerating the speed of each signature, the amount of overlap or shingling is substantially reduced and may even be eliminated. The signatures 10 are then ejected (FIG. 1*b*), along a glide path in a manner to be more fully described, so as to form a stack S (FIG. 1*d*).

Infeed Conveyor Section

Figures 2, 2A, 3:
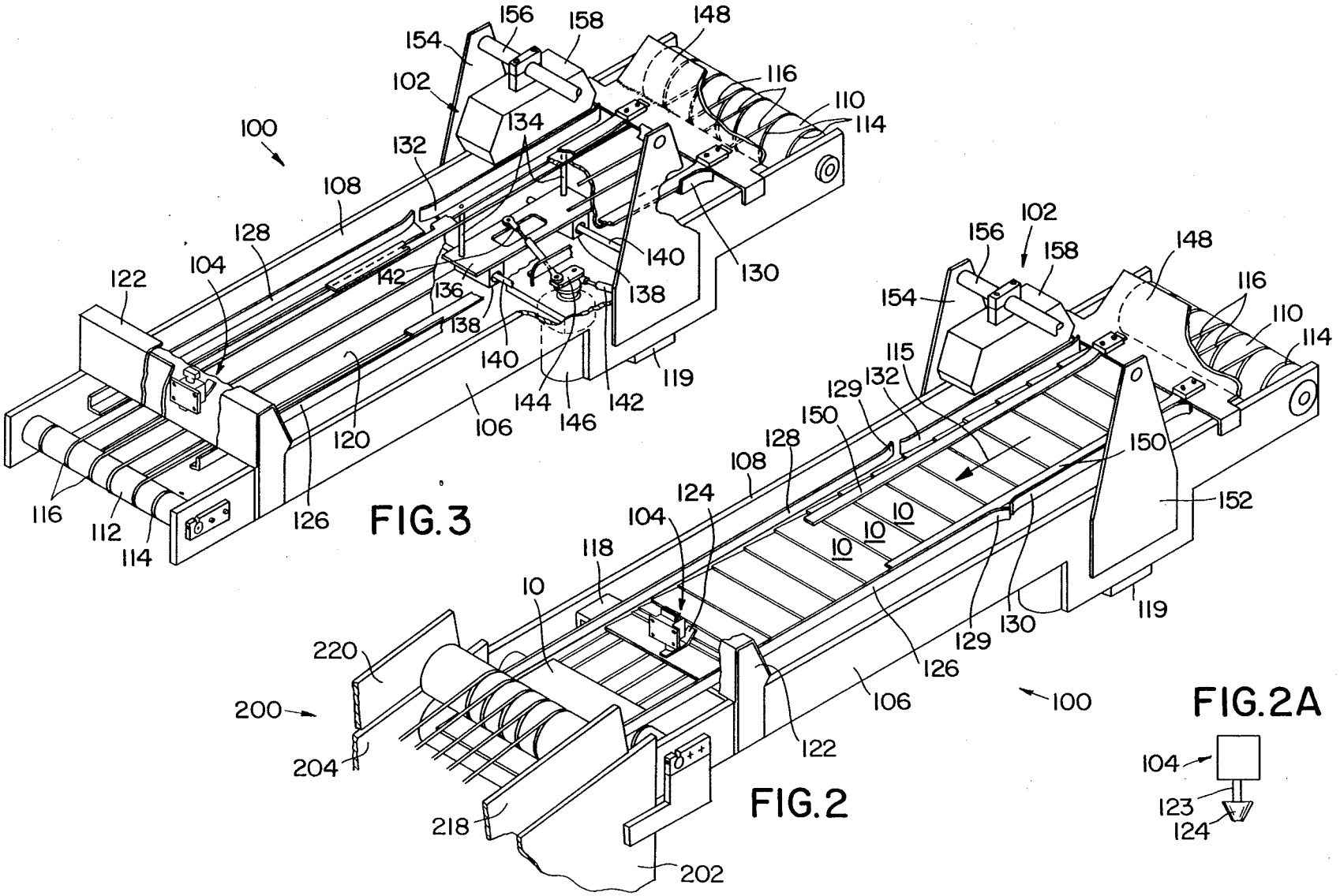
FIG. 2 is a perspective illustration of the infeed conveyor section, a small portion thereof being broken away to illustrate its construction.
FIG. 2A illustrates the presently preferred truncated conical configuration of the flow interrupter pressure foot.
FIG. 3 is a view similar to that of FIG. 2 but with more portions being broken away to illustrate the internal mechanism.

The infeed conveyor section 100 is illustrated in detail in FIGS. 2 and 3. It comprises a pair of elongated parallel side frames 106, 108 which support between their ends a drive roll 110 and an idler roll 112 (FIG. 3). A conventional electric motor drive powers the drive roll 110 and is not illustrated. These rolls have axially spaced, circumferential grooves 114 which carry relatively high-friction bands 116 which serve, collectively, as the conveyor surface. It will be understand that, as viewed in FIG. 2, the rotation of the rolls is counterclockwise, causing the conveyor surface to run from right to left, as shown by the flow arrow 115 in FIG. 2.

Support members 118 (FIG. 2) and 119 connect side frames 106, 108, and the member 118 supports the downstream end of a sheet metal deck 120 (FIG. 3) which underlies the bands 116. A bridge 122 spans the width between the side frames 106, 108 and carries the flow interrupter 104. Basically, flow interrupter 104 is a solenoid with a movable armature 123 (FIG. 2A) carrying a pressure foot 124 which quickly clamps down when the solenoid is energized when the predetermined and manually adjustable count has been reached by the infrared optical counter 102. Although a ski-shaped foot 124 is shown in FIGS. 2 and 3, we presently prefer to use a truncated-cone-shaped foot 124 which has its truncated apex facing downwardly, as shown in FIG. 2A. A pair of angle strip alignment guides 126, 128 are carried by the support member 118 and serve to guide the edges of the signatures 10 moving along the conveyor. The upstream ends of these alignment guides are flared outwardly slightly as shown at 129 for providing a funnel-like entrance leading into these guides. These alignment guides are laterally adjustable in position for adjusting the width of the spacing between them for accommodating printed products 10 of various widths, depending upon the particular items 10 being printed.

Near the input end of the conveyor section 100 is a pair of vibrating or oscillating side guides 130, 132. Referring to FIG. 3 it will be noted that each of side guides 130, 132 is mounted on posts 134 above a movable plate 136 (only one of which is seen). Each plate 136, in turn, is mounted by a pair of bearinqs 13B on transverse guide rods 140. Each of the plates 136 is connected by a link arm (connecting rod) 142 to respective pivots in an eccentric crank assembly 144 driven by motor 146. Thus, as the eccentric crank assembly 144 is rotated by the drive motor 146, the vibrating side guides 130, 132 oscillate toward and away from each other for accurately aligning the fast-moving printed products 10. The length of each link arm 142 is adjustable for thereby adjusting the width of the spacing between these oscillating side guides 130, 132 for accommodating the width of the particular printed products 10 being handled at the time.

Extending across the width between the side frame 106, 108, and near the input end of the conveyor section 100, is a curved downwardly sloping sheet metal guide 148 for causing the fast-travelling signatures 10 to make solid or firm contact with the conveyor bands 116. Secured to, and extending downstream from, this guide 148 are a pair of low-friction, stationary, heavy, flexible belts 150, which hold the fast-travelling printed items 10 down firmly against the conveyor bands 116. Supported above the signatures 10 by a pair of brackets 152, 154 is a rod 156 upon which is adjustably mounted a photocell unit 158 in the pre-settable counter assembly 102 for counting the printed products 10 passing below.

Accelerator (Singulator) Section

Figure 4:
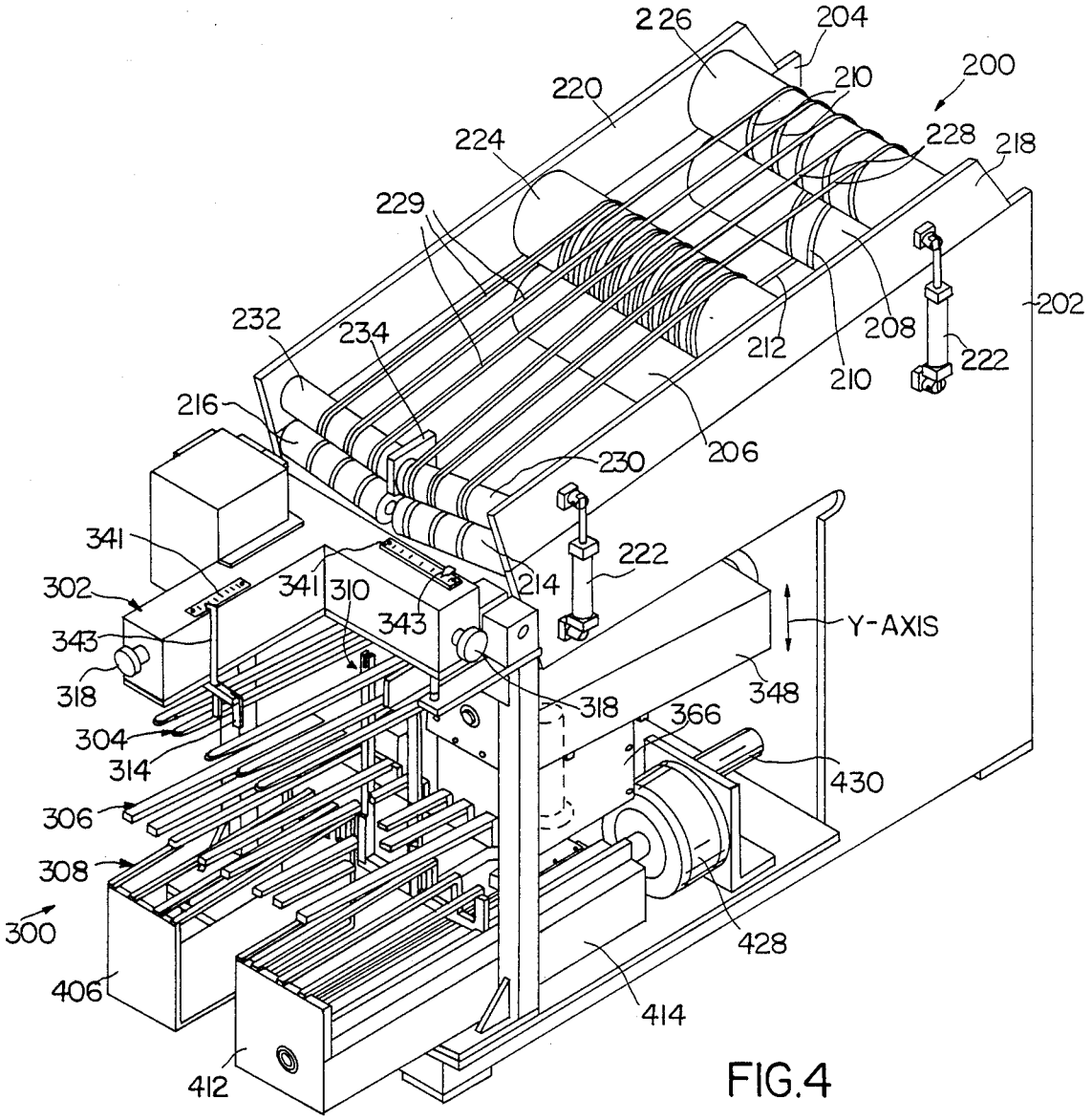
FIG. 4 is a perspective of an assembly including the accelerator section and the stacker section.

The accelerator (singulator) section 200 is illustrated in FIG. 4 where it is shown in an assembly which includes the stacker section 300 (described below). The accelerator section 200 is mounted atop a housing comprising sidewalls 202, 204. Extending between the sidewalls are a lower drive roll 206 and a lower idler roll 208. These rolls are similar to those of the infeed conveyor section 100 in that they include grooves 210 carying lower bands 212 which collectively form a conveyor surface. AS viewed in FIG. 4 these lower rolls 206, 208 rotate in a counterclockwise direction to feed from right to left. At the downstream end of the accelerator section 200 a stub shaft extends from each of the sidewalls 202, 204 and carries one or more grooved rolls 214, 216 each of which is canted downwardly from its associated sidewall to the central region between the two sidewalls for forming a dihedral (please see FIG. 5A) in the printed products prior to their high-speed ejection from the accelerator section 200 into the stacker section 300. There are lower bands 215 (FIG. 5) extending between the lower drive roll 206 and the canted dihedral rolls 214, 216, these bands 215 being carried in grooves 210 in the respective rolls, like the bands 212. The whole conveyor assembly is inclined downwardly in the downstream direction for aiming the ejected printed products to fly downwardly along a glide path to be explained later.

The accelerator section 200 also includes an upper portion comprising a pair of elevatable side frames 218, 220 positioned atop the sidewalls 202, 204 and shown connected thereto in liftable relationship as indicated, for example, by lift cylinders 222. Mounted between these elevatable side frames 218, 220 are upper rolls 224, 226 which correspond to, and are positioned directly above, the respective lower rolls 206, 208. They have similar grooves 210 and bands 228. Sideframes 218, 220 also carry a pair of canted upper rolls 230, 232 similar to and mounted directly above the lower canted rolls 214, 216. There are bands 229 extending from the roll 224 to the canted rolls 230, 232 and being carried in grooves in the respective rolls. The inner ends of the rolls 230, 232 terminate at a block 234 which carries an elongated, spring steel guide strip 236 (FIG.5) which extends downwardly at an inclination into the stacker section 300. The far end of the guide strip 236 is secured at 239 to a stationary part 315 of the stop fence.

The downward inclination of this resilient guide strip 236 generally matches the downward inclination of the central portion of the canted region of the accelerator conveyor as defined by the central bands 215, 229 (FIG. 5) located nearest to the central bearing block 234 near each side of this block. The purpose of this guide strip 236 is resiliently to hold down and guide the central dihedral folded region 238 (FIG. 5A) of the printed products 10 as they fly rapidly through the air along a downward sloping glide path 303 (FIG. 5) with the central nose region 244 of the leading edge aimed toward the central target region 305 on the stack starter 304.

As shown in FIG. 5A the central folded region 238 causes the two lateral portions 239, 240 of the printed product to slope upwardly and outwardly like wings on a glider. In addition to the central guide strip 236, there are two parallel side guide strips 235, 237 (FIG. 5A) spaced laterally from the central guide strip 236 for keeping the "wings" 239, 240 of the printed items 10 from flying upwardly. These spring steel strips 235, 236, 237 are about $\frac{3}{8}$ to $\frac{1}{2}$ of an inch wide. The two flexible side guide strips 235, 237 contact the top of the stack farther. away from the accelerator 200 than the central guide strip for accommodating the wings 239, 240, which are higher than the central bend region 238.

As shown in FIG. 5, the angle of approach "A" between the central dihedral fold region 238 of the flying printed product 10 and the stack starter 304 is adjusted to be less than 40 degrees as the maximum upper limit for avoiding undue impact. The downward inclination of the central region 238 to horizontal is adjusted to be less than about 30 degrees. The preferred range of downward inclination is from about 16 degrees to about 8 degrees and for most printed products is optimally in the range from about 12 degrees to about 8 degrees. The upward inclination "U" of the stack starter 304 relative to the horizontal is less than about 10 ; degrees and preferably is in the range from about 8 degrees to about 4 degrees and for most printed products is optimally in the range from about 6 degrees to about five degrees. For example, FIG. 5 shows a downward inclination of travel 303 of about 10 degrees and an upward inclination "U" of the stack starter 304 of about 5 degrees, thus giving an approach angle "A" of about 15 degrees.

The dihedral angle "D" (FIG. 5A) of the central folded region 238 is in the range from about 10 degrees to about 5 degrees and is preferred to be about 7 degrees. Too much dihedral angle "D" of the central folded region 238 causes trouble because the side edges of the sheets begin to become slid (displaced) relative to each other, such as occurs when simultaneously folding multiple thicknesses of sheets, thus disrupting registration and causing too stiff impact at 305 of the dihedral nose 244 and disrupting the desired flattening down action onto the stack by trailing edge portions 246. Too little dihedral does not allow the product to fly in sufficiently stabilized manner for the very high rates of stacking action such as described herein and which are attainable by employing these advantageous ranges of angular relationships specified.

Figure 5B:
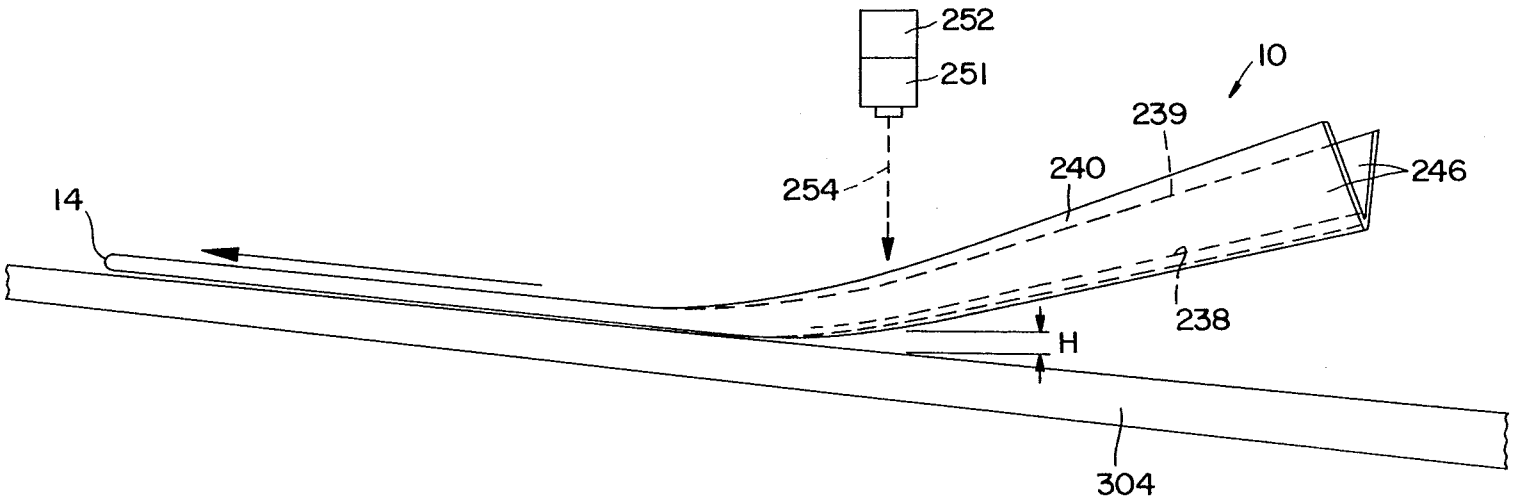
FIG. 5B is a side elevational view generally similar to FIG. 5 but showing the printed product farther advanced than in FIG. 5.

FIG. 5B shows the desired "fade out" into a flat condition of the trailing portions 246 of the "wings" (two lateral regions) 239 and 240. The target area 305 of the dihedral nose 244 onto the stack is near the middle of the top of the stack or somewhat closer to the discharge end of the accelerator 200. In other words, the "window" for the target area 305 is in the range from a farther limit of about 60% of the way across the top of the stack to a closer limit of about 35% of the way across the stack top. When initial impact occurs near the farther limit of the target area 305, then the trailing portions 246 tend to "flop down" onto the stack. On the other hand, when initial impact occurs near the closer limit of the target area, the trailing portions tend to "snap down" onto the stack. Too far a target area 305 away from the accelerator 200 is likely to allow a floppy action or collapsing of the printed product 10 with consequent loss of accurate control. Too close a target area may cause undue impact and may cause the leading edge 14 of some of the printed products not to slide all of the way over to the stop fence 314.

It is noted that the upward inclination "U" serves to use gravitation advantageously for decelerating the fast-travelling printed products as they approach the stop fence 314.

In order to control the downward movement of the stack starter 304 relative to the rate of build-up of the stack for keeping the target area 305 within the desired "window" described above, there are two ultrasonic sensors 251, 252 (FIG. 5B) aimed downwardly as indicated by the arrow 254, for sensing the height "H" of the dihedral nose 244 above the top of the stack. The maximum tolerable range of this height "H" is about one inch, and the preferred range for "H" is about ⅜ to about ½ of an inch. The first sensor 251 is a "too low" sensor , meaning that "H" has reached the lower portion of its range. Thus, a control signal is given by this sensor 251 for causing the stack starter 304 to move downwardly faster for increasing "H" with respect to subsequently arriving items 10. The second sensor 252 is a "too high" sensor, meaning that "H" has reached the upper end of its range. A control signal is given by this second sensor 252 for causing the stack starter 304 to move downwardly more slowly for decreasing "H" with respect to subsequently arriving printed products. It is to be understood from FIGS. 5, 5A and 5B that the glide path of the printed product having its wings 239, 240 bent up at a dihedral angle causes differing angles of approach "A" for different points along the leading edge 14. The foregoing discussion is of the relationships relative to the nose 244 and relative to the central bent region 238.

For causing the trailing portions 246 to move down smartly onto the stack, there is a nozzle 256 aimed downwardly for providing a timed down blast 258 of pressure-regulated "shop air", which is regulated to be in the range from about 8 p.s.i. gage to about 30 p.s.i. gage.

The orientation of the rolls and the bands of the accelerator section 200 is such as to firmly grasp printed products exiting from the infeed conveyor section 100 and to eject them from the canted rollers at the downstream end, as indicated by the dashed glide path arrow 303 in FIG. 5. As previously explained, the accelerator section 200 operates at a higher velocity than the infeed conveyor section. As indicated at 222, the side frames 218 and 220 are liftable for providing convenient access for clearing paper and for maintaining equipment.

Stacking Section

The stacking section 300 is illustrated in FIG. 4 and is positioned to receive printed products ejected by the accelerator section 200, as shown in FIGS. 1(*b*) and 1(*c*) in FIG. 5. Its primary components are a T-shaped stacker head 302, a tined stack starter 304, a tined stack de-elevator 306, a receiving deck 308, and a stack pusher 310.

Figure 7:
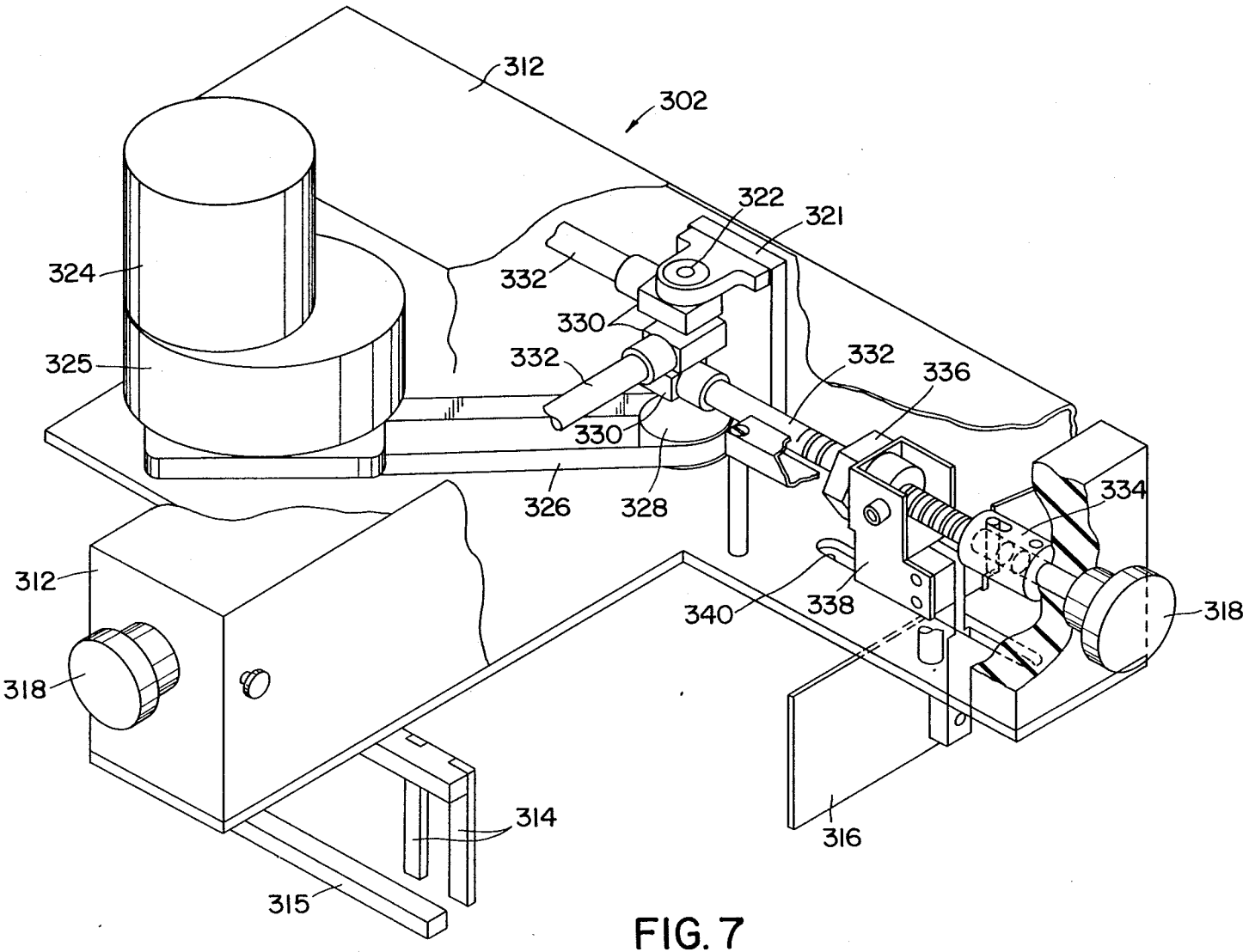
FIG. 7 is a perspective view, partially broken away, of the stacking head portion of the stacker section.

The stacker head 302 is illustrated in detail in FIG. 7. It comprises a T-shaped housing 312. Depending from the housing 312 is a stop-fence 314 and a pair of stack guides 316. The stop fence 314 is positioned so as to intercept printed products ejected from the accelerator section 200. Both it and the stack guides 316 are adjustably positioned by means of knobs 318 to match the dimensions of the printed material being handled. The stop fence 314 and stack guides 316 are also caused to vibrate or oscillate toward and away from the sides of the stack during operation. The adjustment and vibratory mechanisms are essentially the same for the stop fence and for each of the stack side guides, as explained next. There is also a fixed part 315 of the stop fence.

Referring again to FIG. 7, housing 312 encloses a bracket 321 which supports a vertical shaft 322 driven by a motor 324 and speed-reducing transmission 325 via a belt 326 and pulley 328. Mounted on the triple eccentric shaft 322 by means of three eccentric bearing blocks 330 are the ends of three longitudinally reciprocatable lead screws 332. Each of the lead screws 332 extends through a different arm of the T-shaped housing 312 to a different one of the knobs 318 and is supported by a bearing 334. Threadedly mounted to the lead screw 332 is an adjustment assembly comprising a nut 336 and a bracket 338 which depends through a slot 340 in the housing 312 and is connected to the respective edge guide 316 or stop fence 314 for oscillating them toward and away from the sides of the top portion of the stack.

In order to facilitate adjustment of the positions of the stop fence 314 and the stack guides 316 by the knobs 318, there are two index scales 341 (FIG.4) mounted on the housing 312 of the stacking head 302. There is an index scale pointer 343 attached to the stop fence 314 and a similar pointer attached to one of the stack guides 316 for indicating on the respective scale the adjusted positions.

Figure 8:
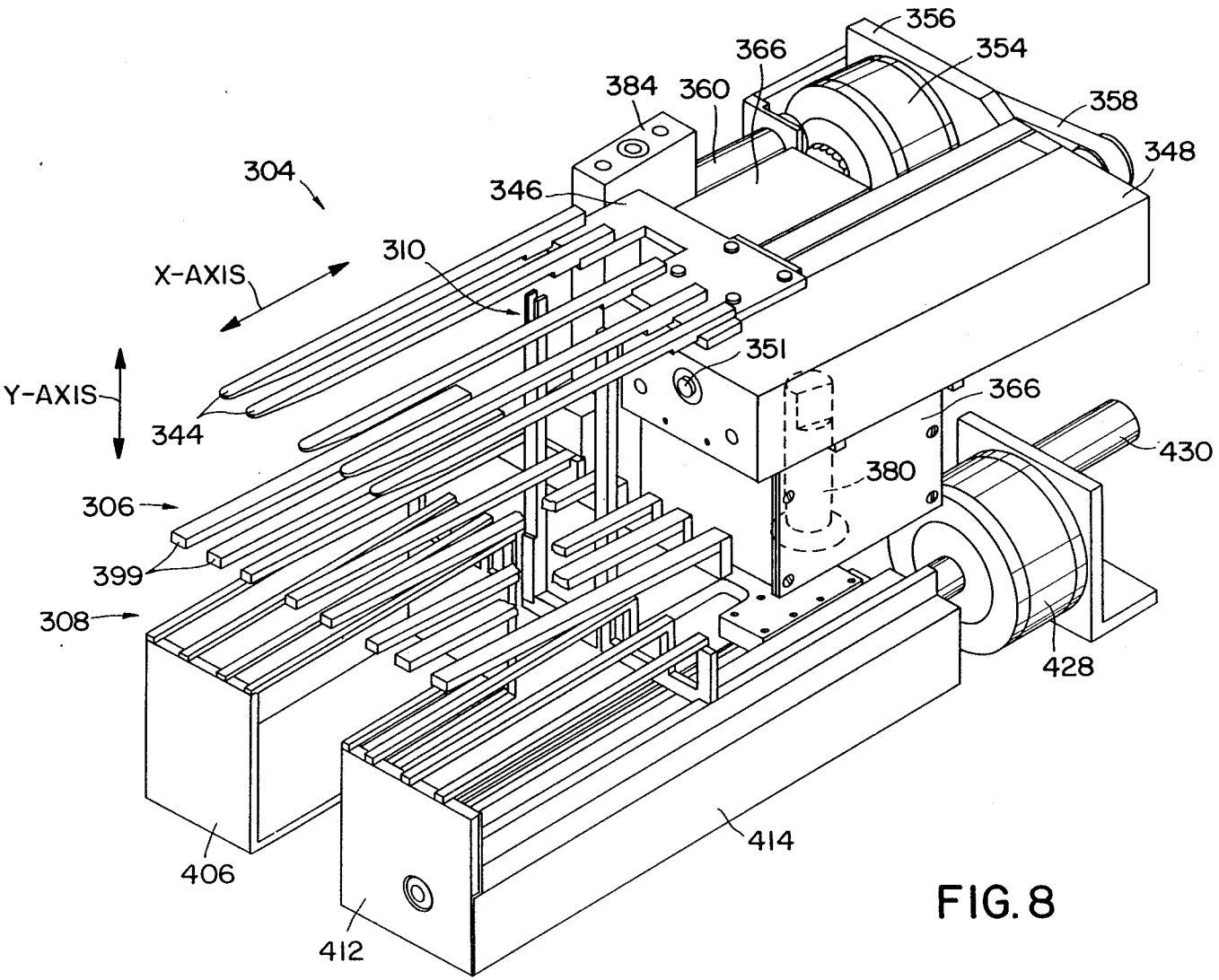
FIG. 8 is a perspective view of the stacker section, portions thereof being broken away.
Figure 9:
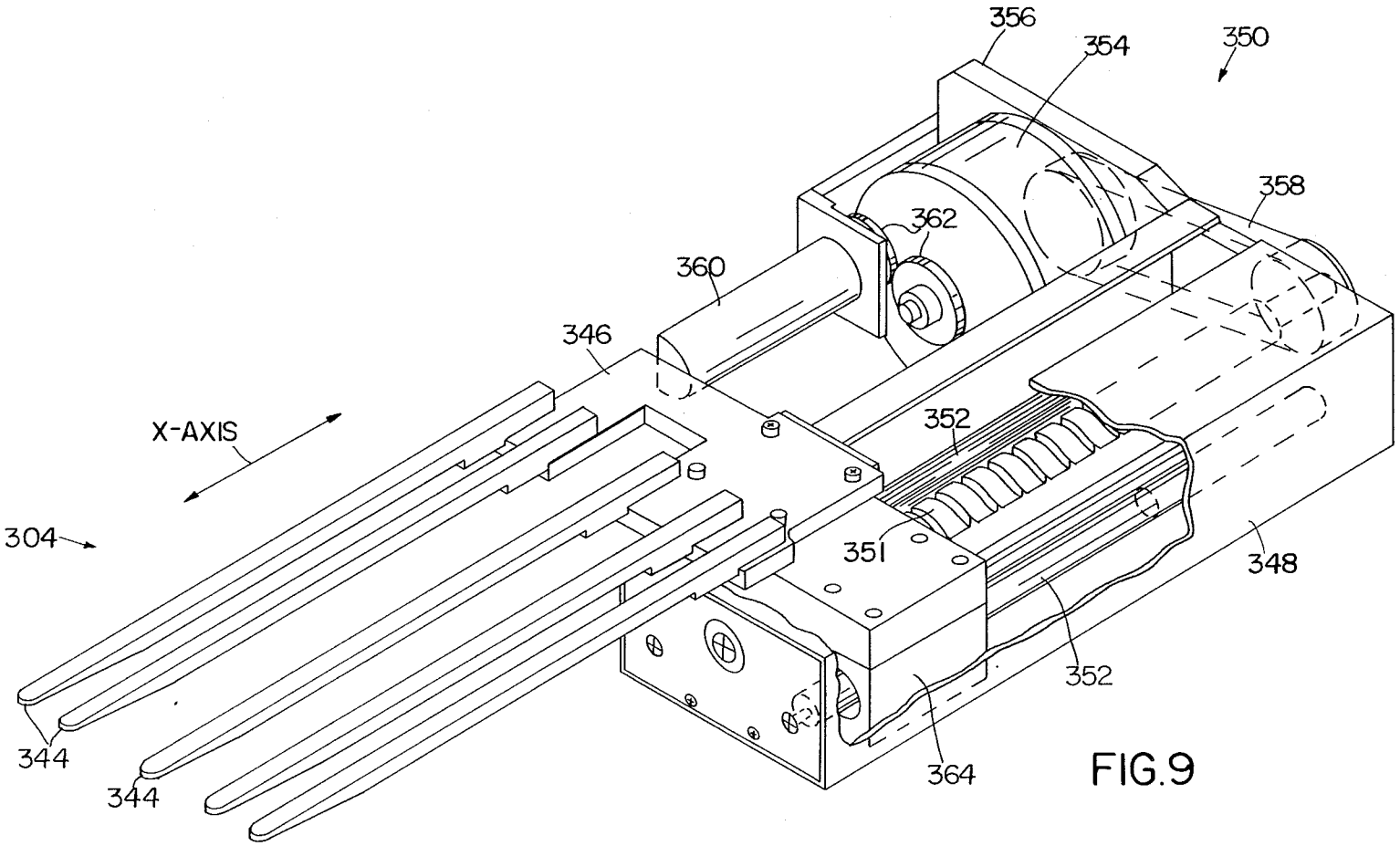
FIG. 9 is a perspective view of the stack starter of the invention together with its x-axis drive mechanism, portions thereof being broken away to illustrate its internal construction.

Positioned directly below the stacker head 302 at the beginning of a stacking cycle is the stack starter 304 (FIGS. 8, 9). The stack starter 304 is a platform comprising tines 344 which extend from a shelf 346. The stack starter 304 is designed for advancement and retraction along the horizontal x-axis, and also for vertical movement along the y-axis. The x-axis drive 350 is illustrated in FIG. 9. It comprises a housing 348 which encloses a helically grooved lead screw 351 and a pair of spaced, parallel guide rods 352 located on opposite sides of the lead screw. The lead screw 351 extends through the housing 348 and is driven by a stepping motor 354 mounted on a bracket 356. The connection between the motor and lead screw is via a timing belt 358. A position encoder 360 is also driven by the motor 354 via gear train 362. Thus, the exact x-axis position of the stack starter 304 is being sensed at all times by the encoder 360 and is continuously controlled by the stepping motor 354. The shelf 346 of the stack starter 304 is mounted on a horizontal travel block 364. This movable block 364 is threadedly connected to the lead screw 351 by a ball bearing worm nut and is freely movable by linear ball bearing units along the pair of guide rods 352. It will thus be understood that rotation of the lead screw 351 by the motor 354 will result in the block 364 and the stack starter 304 being advanced and retracted along the x-axis by controllable amounts depending upon the actuation of the stepping motor 354.

Figure 10:
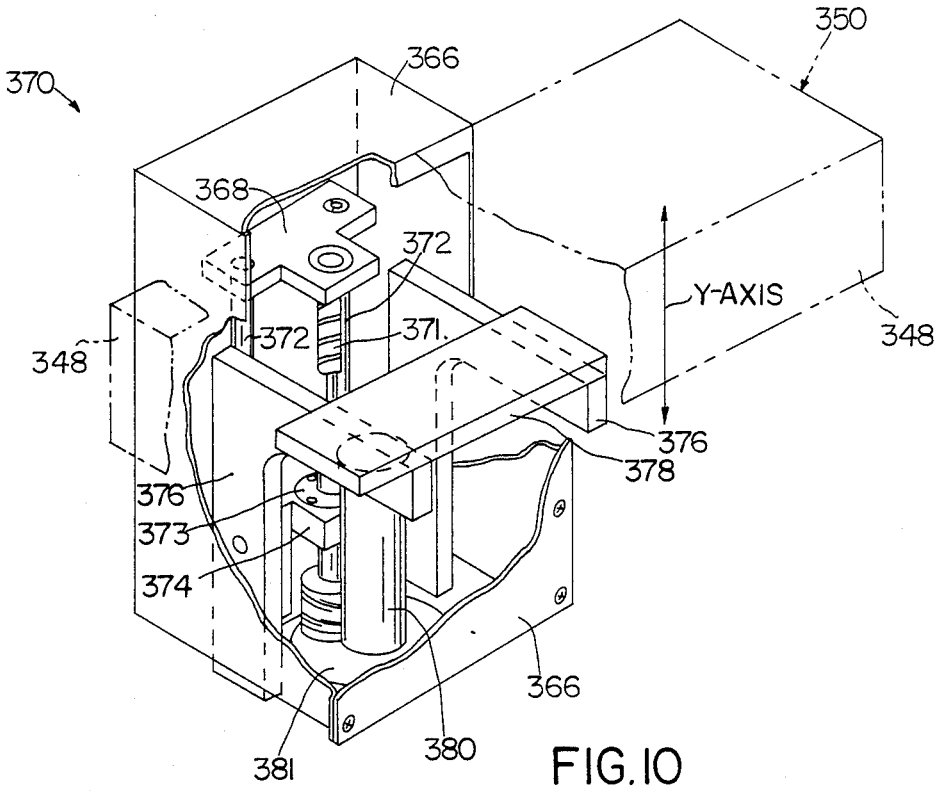
FIG. 10 is a perspective view of the y-axis drive mechanism of the stack-starter, portions thereof being broken away to illustrate its internal construction.

Vertical movement of the whole x-axis drive mechanism 350 and hence vertical movement of the stack starter 304 is achieved by the controllable y-axis drive mechanism 370 illustrated in FIG. 10. This y-axis drive 370 comprises a housing 366 which is generally L-shaped. Supported within the housing 366 by a bracket 368 are a helically grooved lead screw 371 and a pair of spaced parallel guide rods 372 on the opposite sides of the lead screw. Threadedly mounted on the lead screw 371 by a ball bearing worm nut 373 and movable along the guide rods 372 is a vertical travel block 374 which, by means of brackets 376, supports a shelf 378 upon which is mounted the housing 348 of the x-axis drive 350. Thus, the whole x-axis drive 350 is raised and lowered by the y-axis drive 370. Also enclosed within the housing 366 is a y-motion encoder 380. Both the lead screw 371 and the encoder 380 are driven by a stepping motor 381. It will be understood that controlled rotation of the stepping motor 381 and the lead screw 371 will cause the shelf 378 and thus the housing 348 of the x-axis drive to be raised and lowered by exactly controlled amounts.

Figure 11:
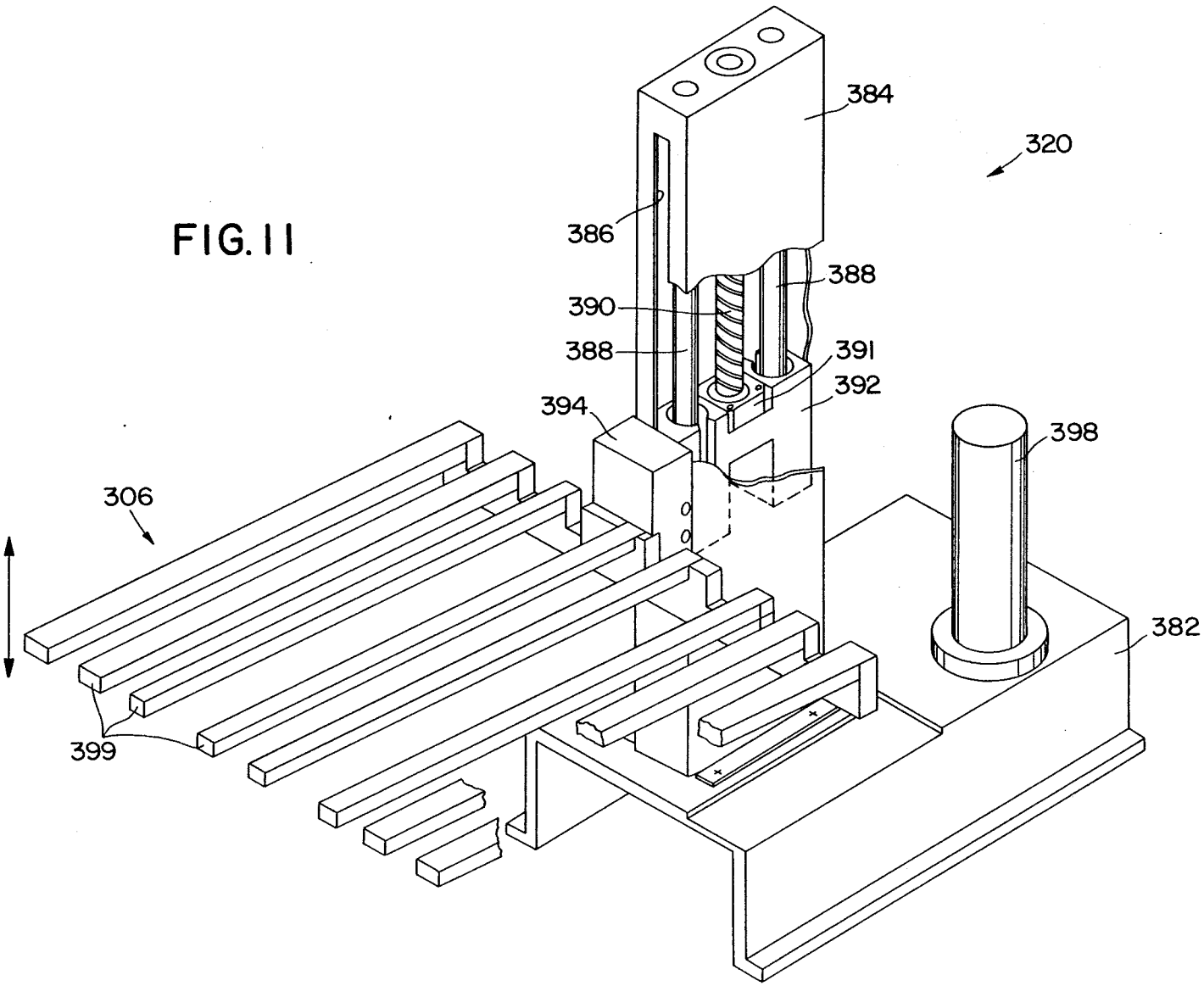
FIG. 11 is a perspective view of the de-elevator portion of the stacker section together with its vertical drive mechanism, portions thereof being broken away to illustrate the internal construction.

The stack de-elevator 306 and its vertical drive 320 are illustrated in FIG. 11. The drive is mounted upon an inverted channel base 382 upon which stands a vertical housing 384 having a vertical slot 386 in its sidewall. Mounted within the housing 384 are a pair of parallel vertical guide rods 388 and a central, helical-groove lead screw 390. A lift block 392 threadedly engages the lead screw 390 by means of a ball bearing worm nut 391 and moves by linear ball bearings along the guide rods 388 under the control of a stepping motor (not shown) located within the channel support 382. A portion of the lift block 392 extends through the slot 386 and carries a bracket 394 which, in turn, is connected to the tined de-elevator platform 306. A de-elevator position encoder 398 is driven by the same stepping motor that drives the de-elevator platform 306. Thus, the exact vertical position of the de-elevator 307 is sensed at all times by the encoder 398 and is controlled by actuation of the stepping motor drive of the lead screw 390. The individual tines 399 of the platform 306 are positioned so as to pass interjacent the tines 344 of the stack starter 304 and also through the bars of the receiving deck described below.

Figure 12:
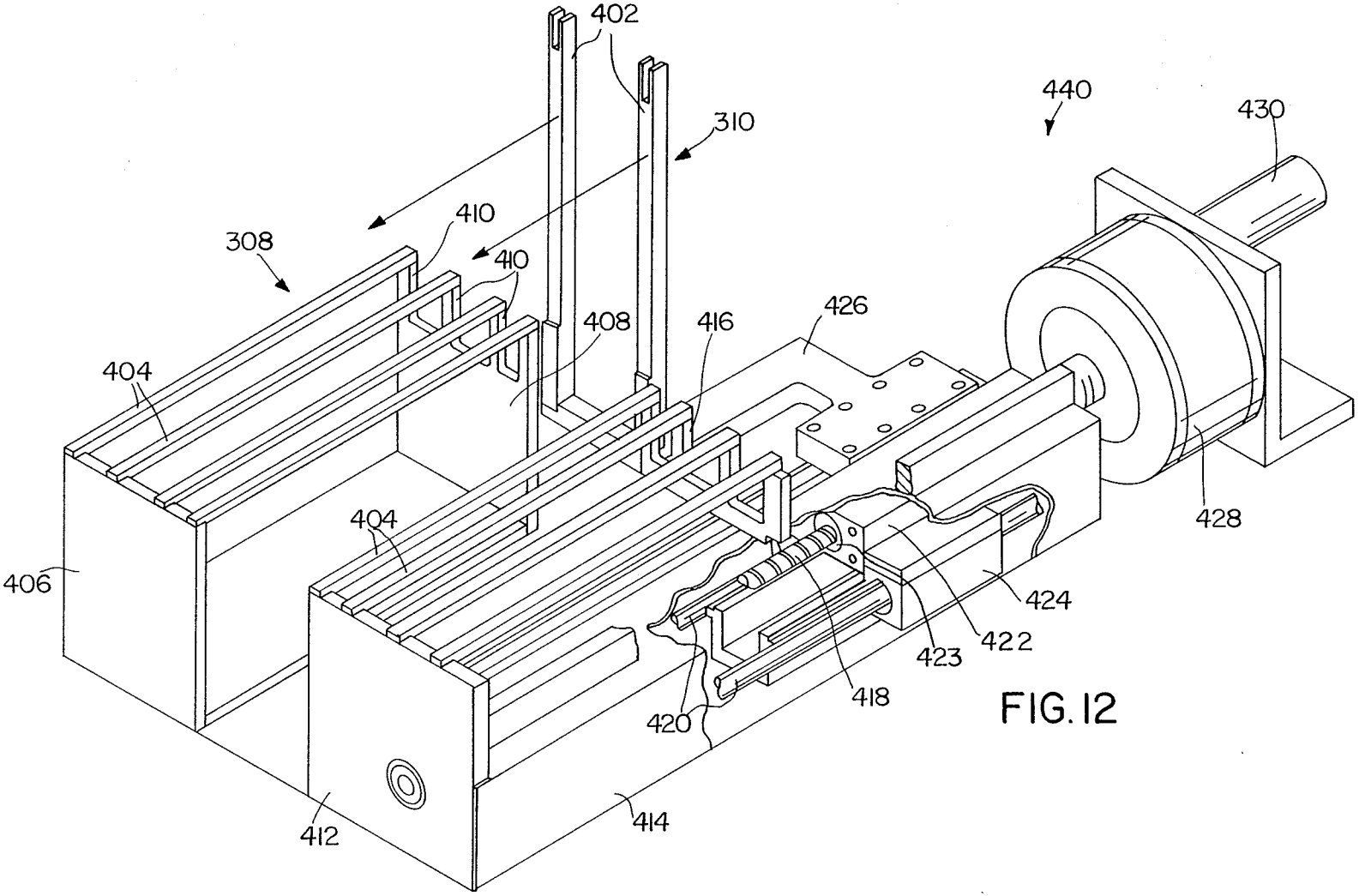
FIG. 12 is a perspective view of the receiving deck and pusher portions of the stacker section together with its horizontal drive mechanism, portions thereof being broken away to illustrate its internal construction.

In FIG. 12 there is illustrated the receiving deck 308, the stack pusher 310, and the pusher drive mechanism 440. The receiving deck 308 comprises two sets of parallel bars 404. One set of bars 404 extends between a pair of uprights 406, 408, the upright 408 having relieved portions 410 permitting access of the tines 399 of the de-elevator platform 306. The other set of bars 404 extends between an upright 412, which also forms one end of a housing 414 for the pusher mechanism, and a bracket 416 which extends across the top of housing 414 and is relieved for access for the tines 399 (FIG. 11) in a similar fashion as upright 408.

The stack pusher mechanism 310 shown in FIG. 12 is driven horizontally by its horizontal drive 440 including a helically grooved lead screw 418 and a pair of parallel guide rods 420. A horizontal travel block 422 engages the lead screw 418 through a ball bearing worm nut 423 and travels along the guide rods 420 being supported by linear bearing members 424. The block 422 carries an L-shaped bracket 426 which supports at its distal end two vertical pusher arms 402. The lead screw 418 is driven by a stepping motor 428 which also drives a position encoder 430 for sensing the position of the pusher arms 402.

It is to be noted that the stack pusher mechanism 310 may be driven horizontally by other drive means than the drive 440 including a lead screw 418 and stepping motor 428. For example, a pneumatic cylinder and piston may be used as the drive means 440 with a piston rod connected to the pusher arms 402 for sliding the completed stack S, as next explained.

As shown in FIGS. 6(*e*) and 6(*d*) the pusher 310 controllably slides the neatly aligned, completed stack S off from the receiving deck 308 onto a take-away conveyor 16 or other removal apparatus. Meanwhile, the next successive stack $S^1$ is beginning to build up on the stack starter 304 as seen in FIGS. 6*d* and 6*e*.

Operation

The signatures, or other printed documents 10, arrive from the printing press or bindery line in shingled alignment and are directed onto the input end of the infeed conveyor section 100. The printed items 10 are shown with their spines 14 facing forward, but as described earlier, the spines 14 may all face to one side or the other to be parallel with the direction of travel. The printed items pass below the guide 148 and between the vibrating side guides 130, 132 which precisely align them. The heavy, low friction stationary belts 150 resting down on the shingled items 10 insure that the fast-travelling items remain flat and do not become air borne. It is to be understood that the subject invention is a high speed stacker which might operate at a rate of, for example, 80,000 signatures per hour. Accordingly, the conveyor section 100 is operating at a relatively high rate of speed as the signatures pass below the counter unit 102. When the desired number for making a stack has passed, and this number depends upon the thickness of the printed products 10 and upon the purpose for which the stack is to be made, the solenoid of flow interrupter 104 is actuated, and the pressure foot 124 is pressed downwardly to engage and momentarily stop the flow of printed items 10. The maximum travel of this pressure foot 124 might be, for example, approximately ½ inch. The slanted shape of foot 124 (FIG. 2A) avoids sudden impact from the leading edges 14, which might result in the printed items 10 becoming misaligned. There will then be a brief accumulation back-up of three or more printed products 10 until the pressure foot 124 rises, permitting resumption of flow of the printed items.

As shown in FIG. 2 the printed products 10 pass sequentially into the receiving rolls of the accelerator 200. Each item is grasped between the upper and lower rollers, sharpening the spine fold 14 and squeezing out air. As the accelerator is moving at a higher velocity than the infeed conveyor section 100, the shingle overlap is substantially reduced or eliminated. As the printed items leave the accelerator section 200, they pass between the canted roller pairs 216–232 and 214–230 (FIGS. 4 and 5). Accordingly, they are given a slight bend, or "dihedral" 238 (FIG. 5A) having an angle "D", which is maintained by the presence of the guide spring strips 235, 236 and 237 (FIG. 5A). The central resilient spring strip 236 is aligned directly above and presses down along the dihedral fold 238 and aims the ejected printed product 10 along a glide path 303 targeted for the central bend nose region 244 of the forwardly facing leading edge 14 to impact at the target area 305 near the center of the stack starter 304, which is the center of the top of the stack S (FIGS. 6*b* and 6*e*) being built up. Ultrasonic sensors 251, 252 (FIG. 5B) control the downward movement of the stack starter 304 relative to the build-up of the stack for keeping the target area 305 within a desired "window" near the center of the top of the stack.

As the first item 10 of a new stack $S^1$ is ejected, it comes into contact with the upwardly inclined stack starter 304, slides upwardly therealong and bumps into the stop fence 314 carried by the stacker head 302 (FIG. 7). Subsequent airborne printed products are similarly stopped by the stop fence 314. Although they are moving at a relatively high rate of speed, the stiffness imparted by the slight dihedral 238 prevents them from crumpling. The stack starter 304, as controlled by the sensors 251, 252 (FIG. 5B), descends at a rate corresponding to the stack building rate. As the new stack $S^1$ builds, the mechanism within the stacker head 302 causes a portion of the stop fence 314 and the edge guides 316 to vibrate slightly. This agitation of successive printed products 10 causes them to be accurately aligned upon the stack.

As the stack $S^1$ continues to build, and as the stack starter 304 continues to descend, the de-elevator 306 is rising, as illustrated schematically by comparing FIG. 6(*b*) with 6(*a*). As shown by comparing FIG. 6 (*b*) with FIG. 6*c*, the stack de-elevator 306 quickly reaches the same level as the stack starter 304 and its tines 399 pass between the tines 344 of the stack starter, thereby acquiring and thereafter supporting the building stack. The stack starter 304 is lowered a bit more, and then the x-axis retracting mechanism 350 shown in FIG. 9 comes into play. The stack starter 304 is withdrawn, as shown in FIG. 6*c*, by the operation of the x-axis drive motor 354 (FIG. 9) acting through lead screw 350 until the stack starter 304 is out of the way of the building and downwardly moving stack $S^1$ now being carried upon the de-elevator 306 as is shown in FIG. 6(*c*). The y-axis lifting mechanism 370 of FIG. 10 then begins to raise the stack starter 304 as seen in FIG. 6(*c*). The retracted stack starter 304 is quickly raised by its y-axis drive 370 to its fully elevated position illustrated in FIG. 6*a* and 6*d* from which it may be once more extended horizontally by its x-axis drive 350, as shown in FIG. 6*d* for the stack starter 304 to begin the stack building cycle anew.

Figure 6D:
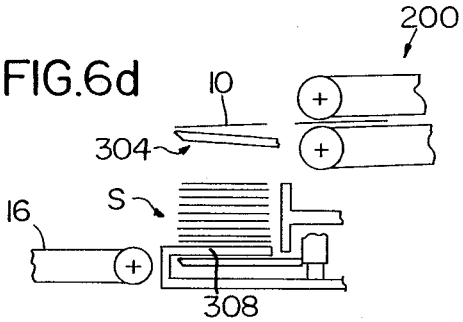
FIGS. 6 (*a*)-(*e*) are a series of schematic illustrations of multiple, sequential steps in the stack-building process.
Figure 6E:
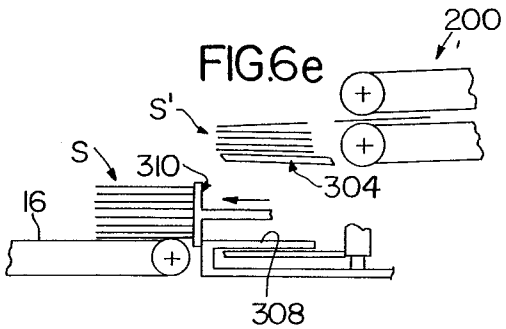
Figure 6A:
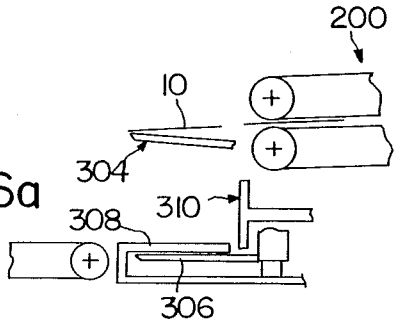
Figure 6B:
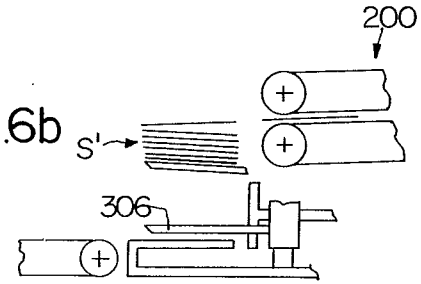
Figure 6C:
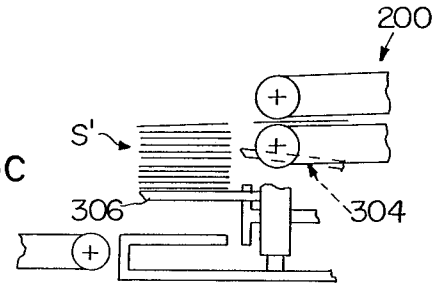

When the stack S has been completed by the addition of the desired number of printed products, the de-elevator 306 is accelerated downwardly and its tines 399 pass between the bars 404 in the receiving deck 308, thereby positioning the stack S on the surface of the receiving deck 308 as seen in FIG. 6*d*. As the stack building cycle begins once more, the horizontal pusher drive 440 (FIG. 12) is actuated, and the pusher drive motor 428 rotates the lead screw 418, thereby advancing the arms 402 of the pusher 310, sliding the stack S off of the receiving deck 308 and onto a conveyor 16 or any other suitable transporter. Other suitable horizontal drive means 440 may be used, as described above, for moving the pusher 310 horizontally.

It is believed that the many advantages of this invention will now be apparent to those skilled in the art. It will also be apparent that a number of variations and modifications may be made in the embodiment of this invention without departing from its spirit and scope. For example, a counter 102 (FIGS. 1(*a*) and 3) causes the completed stacks to contain a predetermined number of printed products (documents) 10. It will be understood that the predetermined amount of printed products in the completed stack can be controlled as a function of other suitable criteria, for example, such as stack height or weight or size. Thus, the term "predetermined amount" is to be interpreted broadly to include such other suitable criteria for controlling the amount of items in the completed stack. Accordingly the foregoing description is to be construed as illustrative only, rather than limiting. This invention is limited only by the scope of the following claims including equivalents of the claimed elements.

We claim:

1. The method of forming a plurality of stacks each containing a predetermined amount of printed products from a plurality of printed products being advised in aligned and shingled relationship on a substantially horizontal linear conveyor, said method comprising the steps of:

sequentially accelerating said printed products to thereby reduce, or eliminate, the shingled relationship;

depositing a first of said accelerated printed products onto a receiving surface, said receiving surface being in an initial position;

sequentially depositing subsequent accelerated printed products onto the first to form a substantially vertical stack;

lowering aid receiving surface from said initial position during the formation of the vertical stack;

raising a de-elevating surface to receive a partially completed vertical stack from the receiving surface;

retracting the receiving surface;

lowering the de-elevating surface while continuing to build said stack to said predetermined amount of printed products;

raising the retracted receiving surface;

removing said stack from the de-elevating surface;

extending the receiving surface to said initial position for repeating the foregoing sequence of steps for forming each successive stack;

wherein the depositing step is preceded by the step of bending each of said printed products in a central dihedral bend extending in the direction of travel to impart stiffness thereto; and wherein each printed product after being bent in said central dihedral bend is launched in said direction of travel along a downwardly inclined glide path with said central bend region being aimed on downward inclination to horizontal of less than about 30 degrees and more than about 4 degrees, wherein said receiving surface is inclined upwardly relative to said direction of travel at an angle of horizontal of less than about 10 degrees and more than about 4 degrees.

2. The method of claim 1 wherein the downwardly gliding printed product is aimed for the leading edge of the central bend region to impact on a target area of the top of the stack near the center of the top.

3. The method of claim 2 wherein said target area is within a a range between a farther limit of about 60 degrees and a closer limit of about 35 degrees of the way across the stack top.

4. The method of claim 1 wherein said central dihedral bond has an angle "D" in the range from about 10 degrees to about 5 degrees.

5. Apparatus for forming a plurality of document stacks capable of operating at a rate of at least 18,000 documents per hour from a plurality of documents advancing in aligned and shingled relationship on a substantially horizontal linear conveyor comprising:

means for sequentially accelerating said documents to thereby reduce, or eliminate, the shingled relationship;

means for sequentially guiding accelerated documents to be deposited to form a substantially vertical stack on a receiving surface;

means for lowering said receiving surface during the formation of the vertical stack;

means for raising a de-elevating surface to receive a partially completed document stack from the receiving surface;

means for retracting the receiving surface;

means for lowering the de-elevating surface while continuing to build the stack to a predetermined amount of documents; and means for removing the stack from the de-elevating surface;

wherein said accelerating means comprises:

first and second conveyor surfaces engageable with each other between an input location and an ejection location and further engageable with opposite sides of a document to grasp each succeeding document from the linear conveyor and convey it from the input location to ejection location to there eject the document at high speed; and means for forming both said first and second conveyor surfaces into complementary V-shaped alignment at the ejection location to impart a stiffening dihedral fold to each ejected document, said dihedral fold extending in the direction of travel of each ejected document.

6. The apparatus of claim 5 wherein said means for sequentially guiding accelerated documents include a guide strip extending outwardly from the apex of said V and above the dihedral fold of each document, said guide strip extending in the direction of travel of the ejected documents for guiding the documents to a position over the receiving surface.

7. The apparatus of claim 6 wherein each document having a dihedral fold has first and second wing-like side portions, said apparatus having second and third guide strips spaced from said guide strip and extending generally parallel with said guide strip, said second and third guide strips extending above the respective first and second wing-like side portions for preventing said wing-like side portions from flying upwardly.

8. The apparatus of claim 5 including air blast means for directing a blast of air downwardly upon a trailing portion of each ejected document for aiding in flattening the trailing portion of each document downwardly upon the stack being formed.

9. A stacking method for forming a stack of printed products from a multiplicity of printed products moving forward at speed in a downstream direction in shingle overlap relationship being fed along a conveyor, said stacking method comprising the steps of:

providing an acceleration region, directing the conveyor into said acceleration region, increasing the forward speed of each successive printed product entering the acceleration region for substantially reducing or eliminating its shingle overlap with the next successive printed product, said increasing forward speed occurring while continuing the forward motion of printed products entering the acceleration region, shaping each successive printed product having increased forward speed into a dihedral configuration, providing a support on which to support a stack of printed products as the stack is being formed by successive printed products put on top of the stack in alignment with the stack, defining a height range associated with the top of the stack.

lowering the support as the stack is being formed for keeping the top of the stack within said height range, aiming along a downwardly sloping path toward the top of the stack each successive printed product having increased forward speed and a dihedarl configuration, allowing each successive printed product having such increased forward speed and such dihedral configuration to travel forward along the downwardly sloping path to the top of the stack for landing on top of the stack, after landing on top of the stack allowing each successive printed product to slide forward on top of the stack, and stopping forward sliding of each successive printed product on top of the stack when each successive printed product has come into alignment with the stack.

10. The stacking method as claimed in claim 9, wherein:

said downwardly sloping path has a downward inclination relative to horizontal less than about 30 degrees.

11. The stacking method of as claimed in claim 10, including the step of:

guiding each successive printed product from above as each successive printed product is travelling along said downwardly sloping path.

12. The stacking method as claimed in claim 9, wherein:

said dihedral configuration of each printed product includes a central dihedral fold region and the angle of approach "A" between the central dihedral fold region and the top of the stack is less than 40 degrees.

13. The stacking method as claimed in claim 12, including the step of:

guiding each successive printed product from above and along said central dihedral fold region as each successive printed product is travelling along said downwardly sloping path.

14. The stacking method as claimed in claim 9, including the step of:

increasing the forward speed of each successive printed product entering the acceleration region by an increase in the range from 1.5 to 3.5 times the speed at which the printed products are moving forward along the conveyor.

15. Apparatus for building a stack of printed products from a multiplicity of printed products being conveyed forward by an infeed conveyor at speed in overlapping shingled relationship comprising:

speed-increasing means positioned to receive from the infeed conveyor successive printed products being conveyed forward by the conveyor at speed in overlapping shingled relationship, said speed-increasing conveyor means increasing the forward speed of each successive printed product received from the infeed conveyor for reducing or eliminating its overlapping with the next successive printed product, said speed-increasing conveyor means increasing the forward speed of each successive printed product while continuing the forward motion of printed products received from the infeed conveyor, shaping means positioned to receive each successive printed product having increased forward speed for shaping each successive printed product into a dihedral configuration, support means on which to support a stack of printed products as the stack is being built by successive printed products put on top of the stack in alignment with the stack, lowering means connected with said support means for lowering said support means as the stack is being built for keeping the top of the stack in a predetermined height range, directing means for directing each successive printed product having increased forward speed and dihedral configuration to move forward along a downward sloping path toward the top of the stack to hit the top of the stack while moving forward, and stop means positioned in alignment with the stack on a side of the stack toward which the printed products are moving for allowing each printed product after hitting the top of the stack to slide on the stack before bumping against the stop means.

16. Apparatus for building a stack of printed products as claimed in claim 15, in which:

said downwardly sloping path has a downward inclination relative to horizontal less than about 30 degrees.

17. Apparatus for building a stack of printed products as claimed in claim 16, further comprising:

guide means extending downwardly generally parallel with and positioned above said downwardly sloping path for guiding each successive printed product from above as each successive printed product is moving forward along the downward sloping path.

18. Apparatus for building a stack of printed products as claimed in claim 15, in which:

said speed-increasing conveyor means increases the forward speed of each successive product from 1.5 to 3.5 times the forward speed at which the printed products are being conveyed forward by the infeed conveyor.

19. The method of forming a neatly aligned vertical stack of printed products moving at a relatively high constant speed in shingled relationship with each printed product having a forwardly facing edge comprising the steps of:

accelerating each successive leading printed product to a higher speed for significantly reducing or entirely eliminating such overlap, bending each successive accelerated printed product along a central bend extending perpendicular to the forwardly facing edge for shaping the printed product into a dihedral configuration with its opposite side portions sloping upwardly from its central bend, ejecting each dihedral configured printed product in succession to fly through the air aimed downwardly along an inclined glide path with the central bend region of the forwardly facing edge aimed to land in a targeted area located at about the center of the top of the stack, the central bend of each dihedral configured printed product being aimed on a downward inclination to horizontal at an angle of less than about 30 degrees and more than 4 degrees, stopping the forwardly facing edge of each successive printed product in succession when it reaches a position corresponding with a forward side of the stack toward which the ejected printed product has been moving, and progressibly lowering the stack for causing the stack to descend as the stack is being built up by successive printed products landing on to of the stack, said descent of the stack being provided at a rate comparable with the rate of build-up of the stack for keeping the top of the stack at about the same elevation throughout such stack building for keeping said targeted area at about the same elevation throughout the stack building operation.

20. The method of claim 19 wherein the top of the stack is inclined upwardly in the forward direction at an upward inclination less than about 10 degrees and more than about 4 degrees for utilization gravitation for aiding in decelerating a printed product sliding across the top of the stack toward said forward side of the stack.

21. The method of forming a neatly aligned vertical stack of printed products moving at a relatively high constant speed in shingled relationship with each printed product having a forwardly facing edge comprising the steps of:

accelerating each successive leading printed product to a higher speed for significantly reducing or entirely eliminating such overlap, bending each successive accelerated printed product along a central bend extending perpendicular to the forwardly facing edge for shaping the printed product into a dihedral configuration with its opposite side portions sloping upwardly from its central bend, ejecting each dihedral configured printed product in succession to fly through the air aimed downwardly along an inclined glide path with the central bend region of the forwardly facing edge aimed to land in a targeted area located at about the center of the top of the stack, guiding downwardly along the central bend of each dihedral configured printed product as it flies through the air along its downwardly inclined glide path aimed to land in said targeted area, guiding downwardly on each of two wing-like side portions of said dihedral configured product as it flies through the air along said downwardly inclined glide path for preventing said wing-like side portions from flying upwardly above the glide path, stopping the forwardly facing edge of each successive printed product in succession when it reaches a position corresponding with a forward side of the stack toward which the ejected printed product has been moving, and progressively lowering the stack for causing the stack to descend as the stack is being built up by successive printed products landing on top of the stack, said descent of the stack being provided at a rate comparable with the rate of build-up of the stack for keeping the top of the stack at about the same elevation throughout such stack building for keeping said targeted area at about the same elevation throughout the stack building operation.

22. The method of claim 21 including the further step of applying a downward directed air blast upon a trailing portion of each printed product for aiding in flattening the trailing portion down onto the stack.

23. Apparatus for forming a plurality of document stacks capable of operating at a rate of at least 18,000 documents per hour from a plurality of documents advancing in aligned and shingled relationship on a substantially horizontal linear conveyor comprising:

means for sequentially accelerating said documents to thereby reduce, or eliminate, the shingled relationship;

means for sequentially guiding accelerated documents onto a receiving surface to form a substantially vertical stack;

means for lowering said receiving surface during the formation of the vertical stack;

means for raising a de-elevating surface to receive a partially completed document stack from the receiving surface;

means for retracting the receiving surface;

means for lowering the de-elevating surface while continuing to build the stack to a predetermined amount of documents;

means for removing the stack from the de-elevating surface;

wherein said linear conveyor comprises:

a first driving roll and a second idler roll, said rolls being substantially parallel to one another;

at least one flexible member encircling said rolls to form a conveying surface therebetween;

a deck underlying at least a portion of the flexible member forming the conveying surface;

elongated, parallel, side guides positioned adjacent the conveying surface to align substantially flat, shingled, documents supported by the conveying surface;

means for vibrating at least one of the side guides to facilitate the aligning of the supported documents; and means for selectively interrupting the flow of documents supported by the conveying surface without stopping the conveying surface, said interrupting means comprising a member inclined downwardly forwardly in said advancing direction and movable quickly downwardly against at least on of said documents to clamp it against said deck, said member having a truncated conical configuration with its truncated apex facing downwardly.

24. The method of forming a neatly aligned vertical stack of printed products moving at a relatively high constant speed in shingled relationship with each printed product having a forwardly facing edge comprising the steps of:

accelerating each successive leading printed product to a higher speed for significantly reducing or entirely eliminating such overlap, bending each successive accelerated printed product along a central bend extending perpendicular to the forwardly facing edge for shaping the printed product into a dihedral configuration with its opposite side portions sloping upwardly from its central bend, ejecting each dihedral configured printed product in succession to fly through the air aimed downwardly along an inclined glide path with the central bend region of the forwardly facing edge aimed to land in a targeted area located at about the center of the top of the stack, guiding downwardly along the central bend of each dihedral configured printed product as it flies through the air along its glide path aimed to land in said targeted area, stopping the forwardly facing edge of each successive printed product in succession when it reaches a position corresponding with a forward side of the stack toward which the ejected printed product has been moving, and progressively lowering the stack for causing the stack to descend as the stack is being built up by successive printed products landing on top of the stack, said descent of the stack being provided at a rate comparable with the rate of build-up of the stack for keeping the top of the stack at about the same elevation throughout such stack building for keeping said targeted area at about the same elevation throughout the stack building operation, wherein each printed product has a folded spine edge comprising the further step of:

squeezing each successive printed product as it is accelerated for sharpening the folded spine edge and for squeezing air out from between the pages of the printed product near the spine edge.

25. The method of forming a neatly aligned vertical stack of printed products moving at a relatively high constant speed in shingled relationship with each printed product having a forwardly facing edge comprising the steps of:

accelerating each successive leading printed product to a higher speed for significantly reducing or entirely eliminating such overlap, bending each successive accelerated printed product along a central bend extending perpendicular to the forwardly facing edge for shaping the printed product into a dihedral configuration with its opposite side portions sloping upwardly from its central bend, said dihedral configuration having a dihedral angle "D" in the range from about 10 degrees to about 5 degrees, ejecting each dihedral configured printed product in succession to fly through the air aimed downwardly along an inclined glide path with the central bend region of the forwardly facing edge aimed to land in a targeted area located at about the center of the top of the stack, stopping the forwardly facing edge of each successive printed product in succession when it reaches a position corresponding with a forward side of the stack toward which the ejected printed product has been moving, and progressively lowering the stack for causing the stack to descend as the stack is being built up by successive printed products landing on top of the stack, said descent of the stack being provided at a rate comparable with the rate of build-up of the stack for keeping the top of the stack at about the same elevation throughout such stack building for keeping said targeted area at about the same elevation throughout the stack building operation.

* * * * *